US009509110B1

(12) United States Patent
Buck et al.

(10) Patent No.: US 9,509,110 B1
(45) Date of Patent: Nov. 29, 2016

(54) ADAPTER FOR LED STRIP LIGHT

(71) Applicant: Elemental LED, Inc., Emeryville, CA (US)

(72) Inventors: Wesley Buck, Alameda, CA (US); James Stillman, Shenzhen (CN)

(73) Assignee: Elemental LED, Inc., Emeryville, CA (US)

( * ) Notice: Subject to any disclaimer, the term of this patent is extended or adjusted under 35 U.S.C. 154(b) by 0 days.

(21) Appl. No.: 15/202,968

(22) Filed: Jul. 6, 2016

Related U.S. Application Data

(60) Provisional application No. 62/316,376, filed on Mar. 31, 2016.

(51) Int. Cl.
*H01R 31/06* (2006.01)
*H01R 13/58* (2006.01)
*H01R 103/00* (2006.01)

(52) U.S. Cl.
CPC ..... *H01R 31/06* (2013.01); *H01R 13/582* (2013.01); *H01R 2103/00* (2013.01)

(58) Field of Classification Search
CPC ..... F21S 4/008; F21S 4/28; F21S 4/00; F21V 23/06
USPC ..... 439/286, 495, 496, 260, 638; 174/92, 174/93; 362/652, 653, 654, 657–659
See application file for complete search history.

(56) References Cited

U.S. PATENT DOCUMENTS

| | | | | |
|---|---|---|---|---|
| 4,768,969 | A * | 9/1988 | Bauer | A61B 18/16 439/260 |
| 4,952,177 | A * | 8/1990 | Drake | A61B 18/16 439/838 |
| 6,283,612 | B1 * | 9/2001 | Hunter | F21V 15/015 362/217.05 |
| 7,175,303 | B2 * | 2/2007 | Kovacik | F21L 14/023 362/240 |
| 8,714,772 | B1 * | 5/2014 | Levante | F21V 23/06 362/217.17 |
| 8,979,296 | B2 * | 3/2015 | Wiemer | A47F 5/103 362/125 |
| 9,374,856 | B2 * | 6/2016 | Winton | H05B 33/0806 |
| 2010/0008090 | A1 * | 1/2010 | Li | F21V 17/007 362/249.03 |
| 2015/0241035 | A1 * | 8/2015 | Dankelmann | F21V 21/005 362/219 |

* cited by examiner

*Primary Examiner* — Briggitte R Hammond
(74) *Attorney, Agent, or Firm* — PatentBest; Andrew McAleavey

(57) ABSTRACT

A waterproof adapter that connects strip light to a standard power cord, such that the power cord can then be routed to a power source. The adapter has an internal vertical barrier to separate power and ground leads, and gripping structures that help to retain the strip light within the adapter. A gasket or gaskets within the adapter seal the adapter from the elements.

9 Claims, 4 Drawing Sheets

ADAPTER FOR LED STRIP LIGHT

CROSS-REFERENCE TO RELATED APPLICATIONS

This application claims priority to U.S. Provisional Patent Application No. 62/316,376, filed Mar. 31, 2016, the contents of which are incorporated by reference herein in their entirety.

BACKGROUND OF THE INVENTION

1. Field of the Invention

In general, the invention relates to adapters for light-emitting diode (LED)-based lighting systems, and more particularly to adapters for LED strip lights.

2. Description of Related Art

Flexible light-emitting diode (LED) strip lights are well known in the lighting industry, are versatile, and are commonly used in a variety of settings. Low voltage strip lights, typically operating on 12-24 volts of direct current (DC), are suitable for many situations, as they are easy to set-up, cost efficient, and adaptable to a number of different types of applications. Moreover, properly protected from the elements, they may be installed and operated safely outdoors and in wet environments. However, low voltage strip lights are prone to a significant voltage drop over longer distances, making them unsuitable for applications where longer lengths of strip lighting are needed.

For situations requiring longer runs of strip lighting, high-voltage strip lights are preferred, as voltage drop is less of an issue at higher voltages, allowing runs of up to 150 feet or more. High-voltage strip lights typically operate at standard household or commercial voltages, e.g. 120-240V, so often, no transformer is required. However, a rectifier may be used to convert from alternating current (AC) power to DC.

While high-voltage strip lights allow for longer runs and make voltage drop somewhat less of a problem, they come with risks of their own—electric shock, electrocution, and fire among them. Thus, electrical standards, formulated in order to mitigate such risks, often require that power cords or conductors from high-voltage elements be double jacketed or fully enclosed in electrical conduit. While high-voltage strip lights are potentially just as adaptable as their low-voltage brethren, components that allow high-voltage strip lights to be used in different environments while complying with prevailing electrical standards and providing a robust connection are few. Better structures and methods for connecting strip light, and particularly high-voltage strip light, to power would be useful.

SUMMARY OF THE INVENTION

One aspect of the invention relates to an adapter for connecting a strip light to power. The adapter has complementary upper and lower portions that are adapted to be secured together. When engaged, those two portions define a first opening sized and adapted to accept an end of a strip light, a second opening sized and adapted to accept a power cord, and an interior cavity to which the first opening and the second opening connect. A vertical barrier within the interior cavity divides at least a portion of the interior cavity to separate power and ground leads. Gripping structures proximate to the first opening act to secure the strip light. In some embodiments, the vertical barrier may be a two-part, T-shaped barrier with a portion attached to the upper portion of the adapter and a portion attached to the lower portion of the adapter. Additionally, in some embodiments, a gasket or gaskets may enclose the area around the T-shaped barrier, rendering it water-resistant.

Another aspect of the invention relates to an adapter for connecting a strip light to power via a conduit. The adapter has the internal features described above. In addition, one end of the adapter is shaped to connect to a conduit.

Other aspects, features, and advantages of the invention will be set forth in the description that follows.

BRIEF DESCRIPTION OF THE DRAWING FIGURES

The invention will be described with respect to the following drawing figures, in which like elements will be indicated by like reference numerals throughout the views, and in which.

DETAILED DESCRIPTION

Figure 1:
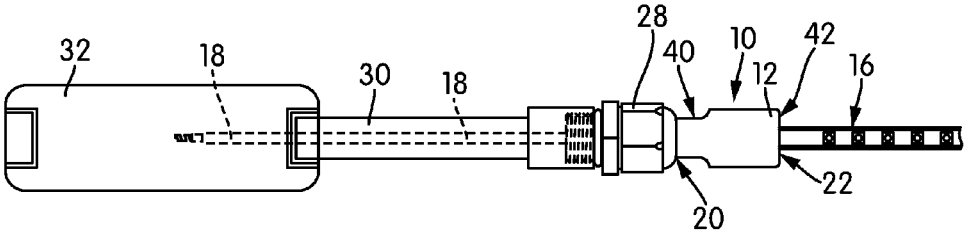
FIG. 1 is a schematic top plan view of a adapter according to one embodiment of the invention, shown as installed.

FIG. 1 is a schematic top plan view of an adapter, generally indicated at 10, according to one embodiment of the invention. As illustrated in FIG. 1, the adapter 10 connects a strip light 16 to a power cord, cable, or conductor 18, and routes that power cord 18 through electrical conduit 30 until it reaches a junction box 32. The electrical conduit 30 may be metal or plastic, and both the conduit 30 and the couplings that connect to it would generally be compliant with applicable electrical standards. In particular, the arrangement of FIG. 1 may be used to provide power to a high-voltage strip light 16 outdoors.

The adapter 10 includes an upper portion 12, a lower portion 14 (best seen in FIG. 2), a conduit adapter opening 20, a high-voltage strip light opening 22, and a conduit adapter portion 40. The adapter 10 receives one end of a high-voltage strip light 16 through the high-voltage strip light opening 22 at the receiving end 42 of the adapter 10, and houses a crimped electrical connection 44 (best seen in FIG. 3) that attaches the high-voltage strip light 16 to a power cord 18. The power cord 18 is routed out of the adapter 10 and into the conduit 30 through the appropriate opening 20 and fittings 28. The adapter 10 itself may also be made out of either metal or plastic, depending on the embodiment, the application, and the environment in which it is to be used.

The terms "low voltage" and "high voltage" vary in meaning depending on which industry source is consulted. For purposes of this description, the term "high voltage" will be used to refer to any voltage greater than about 50V. Alternatively, "high voltage" might also be defined as any voltage for which building or electrical codes would require complete encapsulation or enclosure of the power conductors 18. While the adapter 10 and associated structures may be used for either low voltage or high-voltage components, they are particularly useful for high-voltage components, as their use is intended to comply with electrical codes and standards. In many embodiments, the strip light 16 will be operating at a rectified, direct current voltage equal to common household or commercial voltage—in the United States, about 120V.

The strip light 16 may be, for example, an INFINILINE® 120V AC strip light (Elemental LED, Inc., Emeryville, Calif., United States). Strip light of this type is described in more detail, for example, in U.S. Provisional Patent Application No. 62/344,742, filed Jun. 2, 2016, the contents of which are incorporated by reference herein.

Figure 2:
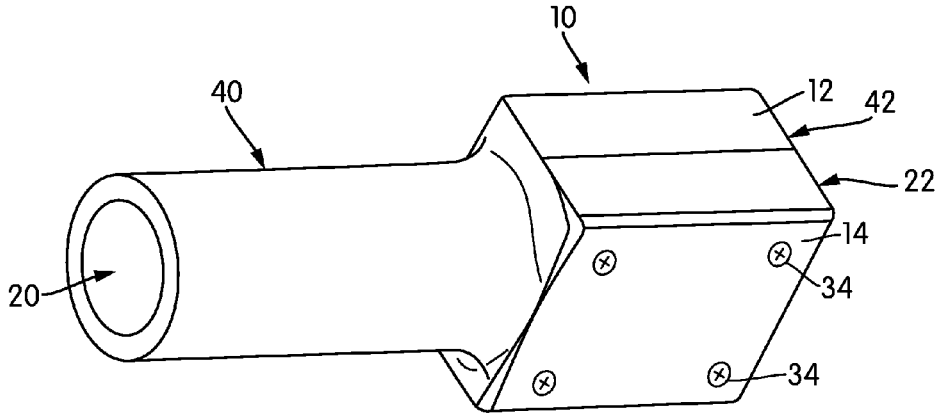
FIG. 2 is a perspective view of the adapter of FIG. 1 in isolation.

FIG. 2 is a perspective view of the adapter 10 of FIG. 1 in isolation. The adapter 10 is hollow with an upper portion 12 and a lower portion 14 that are secured together to form a housing. As illustrated in FIG. 2, the lower portion 14 includes a plurality of fasteners 34 that secure the upper portion 12 to the lower portion 14. In the illustrated embodiment, screws 34 are used to combine the portions 12, 14, although different styles of fasteners 34 can be used to secure the upper portion 12 to the lower portion 14. Moreover, in other embodiments, the two portions 12, 14 may interengage without fasteners 34 (e.g., with adhesives, by snap-fit or interference fit, by heat-fusing, or by other conventional means).

As can be seen in FIG. 2, the receiving end 42 of the adapter 10—the end that receives the high-voltage strip light 16—is generally wider than the conduit adapter opening 20. Additionally, the receiving end 42 of the adapter 10 is generally rectangular and comprises a centered rectangular high-voltage strip light opening 22, whereas the conduit adapter portion 40 and conduit adapter opening 20 are cylindrical. The adapter 10 makes a transition in shape from its receiving end 42 to its conduit adapter opening 20. Generally speaking, the adapter opening 20 would be sized and otherwise adapted to connect with standard sizes of conduit, when deemed necessary.

While a number of sizes and shapes can be useful for a variety of applications, the adapter 10 is generally wider than at least the high-voltage strip light 16 being received at the high-voltage strip light opening 22. At the other end, as one example, the adapter opening 20 may be adapted to connect with standard polyvinyl chloride (PVC) plastic conduit 30. PVC conduit 30 and fittings 28 are commonly available and can be purchased in a variety of sizes (e.g. ¾", ½", etc.); thus, variations in the size of the adapter 10, or at least its connecting end 40, are expected. Of course, in some embodiments, instead of changing the size, shape, or other characteristics of the connecting end 40, standard fittings and adapters may simply be used to connect it to conduit 30 of any size and characteristics.

Figure 3:
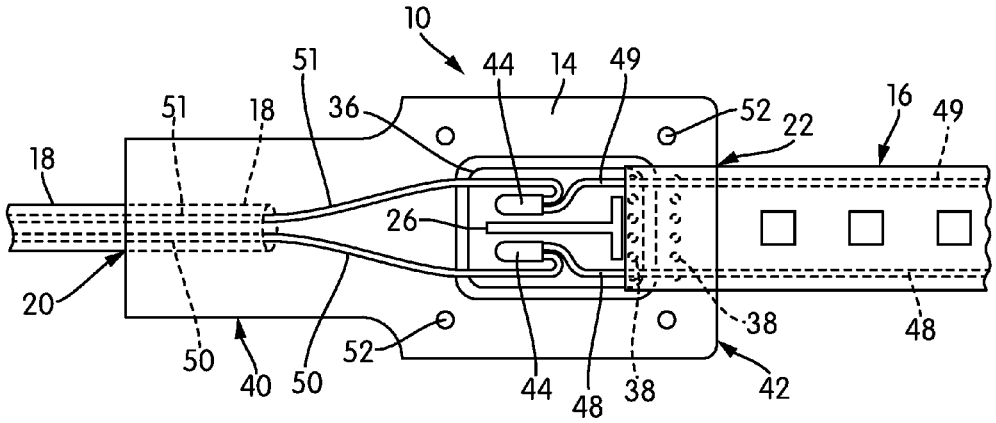
FIG. 3 is a schematic top plan view of the adapter of FIG. 1, illustrating the interior of the adapter.

FIG. 3 is a schematic top plan view of the adapter 10, illustrating its interior. Inside the adapter 10, a vertical wire barrier 26 prevents electrical leads 48, 49, 50, 51 from the high-voltage strip light 16 and power cord 18 from coming into contact with one another and causing an electrical short. The wire barrier 26 is generally T-shaped and has sufficient length and height to keep power and ground leads 48, 49, 50, 51 separated from one another. Typically, a first portion of the wire barrier 26 arises from one of the two housing portions 12, 14 and a complementary, if slightly shorter, portion of the wire barrier 26 arises from the other housing portion 12, 14. The two portions of the wire barrier 26 may "sandwich" or clamp the electrical leads 48, 49, 50, 51 in a way that prevents them from moving. In the illustrated embodiment, the strip light 16 is inserted into the adapter 10 nearly to the position of the transverse portion of the wire barrier 26.

Additionally, one or more gaskets 36 are positioned to water-seal the adapter 10. In the illustrated embodiment, the gaskets 36 may ride in grooves or channels around the area in which the connection is made. The gaskets 36 may be made of silicone, or of any other resilient, water-resistant material, and will be described in more detail below.

Within the adapter 10 and proximate to the strip light opening 22, multiple series of linearly arranged prongs 38, as shown in FIG. 3, are placed strategically to reduce strain on the strip light 16 and secure it in place. These prongs 38 support and bear on the insulation of the strip light 16. More specifically, one row of prongs 38 is placed immediately adjacent to the transverse end of the wall 26, and another row of prongs 38 is spaced from the first row on the outside of the gasket 36. In the illustrated embodiment, both rows of prongs 38 are also parallel to both the transverse end of the wall 26 and the strip light opening 22. Generally speaking, the interior of the adapter 10 may include any components that help it to make a proper electrical connection without shorting, preferably while providing strain relief to at least the strip light 16.

As can be appreciated from FIG. 3, the adapter 10 houses a crimped wire connection 44 between the electrical leads 48, 49, from the strip light 16 and the electrical leads 51, 52 from the electrical cord 18. More specifically, a crimped connection 44 joins a positive strip light electrical lead 48 to a positive cord electrical lead 50, while a separate crimp connection 44 joins a negative strip light electrical lead 49 to a negative cord electrical lead 51. The connection 44 of the illustrated embodiment is made in such a way that the entire segments of exposed wire are covered and electrically insulated. However, the wire barrier 26 provides an additional safety measure to prevent short circuits by isolating the crimp connections 44 within the body of the adapter 10. Any method of producing a crimped connection 44 between wires may be used in embodiments of the invention, and any other methods of making a connection between wires (e.g., soldering, other mechanical connectors, etc.) may also be used, so long as the strip light 16 is connected to the electrical cord 18, the wires are prevented from short circuiting, and the connection fits within the adapter 10.

The adapter 10 of the illustrated embodiment has two gaskets 36, only one of which is visible in the view of FIG. 3. The silicone gaskets 36 are molded such that when the strip light 16 and power cord 18 are in place and the fasteners 34 (best seen in the view of FIG. 2) are secured through fastener holes 52, a waterproof seal is created. In some embodiments, the silicone gasket 36 on the upper portion 12 is fixed in place, while the gasket 36 of the lower portion 14 is removable. While the silicone gasket 36 is rectangular in the plan view of FIG. 3, it may extend continuously along several planes. For example, the silicone gasket 36 may include a dip such that it can extend from a channel in the middle of the interior and dip down (or rise up) in the vertical plane to extend along and seal the strip light opening 22.

In some embodiments of the invention, only one silicone gasket 36 may be necessary to accomplish a watertight seal. Additionally, while the gasket 36 is silicone in the illustrated embodiment, any suitable resilient waterproof resin or other material may be used.

As was described briefly above, multiple series of opposing prongs 38 are linearly arranged on the upper portion 12 and the lower portion 14 of the adapter 10, such that when the adapter 10 is secured, the opposing prongs 38 grip the strip light 16 and power cord 18, fixing it in place and providing strain relief. Two lines of prongs 38 are arranged in parallel (with respect to one another) at the high-voltage strip light opening 22. The prongs 38 can be arranged at different positions relative to the conduit opening 20 and the strip light opening 18. Lines of prongs 38 can be configured on either side of the gasket 36, and additional lines of prongs 38 can be used to further reduce strain on the high-voltage strip light 16 and, if desired, on the power cord 18 and its conductors. For example, in the view of FIG. 3, one of the lines of prongs 38 is arranged within the area sealed by the gasket 36, while another line of prongs 38 is arranged outside of the rectangular silicone gasket 36.

While the prongs 38 are arranged in rows that extend across the width of the adapter in the illustrated embodiment, they could extend in other directions. Moreover, instead of neat rows, prongs 38 could be arranged in some other defined pattern or randomly. Any number of prongs 38 may be used, depending on the degree of strain relief and the degree of gripping that are required in any particular embodiment. While the illustrated embodiment uses prongs 38, in other embodiments, bars and other types of mechanical features may be used to provide internal fixation and strain relief.

FIGS. 1-3 illustrate an embodiment of an adapter 10 that may be particularly suited for wet locations, or anywhere else that a strip light 16 may need to be connected by way of conduit. However, not all installations of strip light 16 will require the use of conduit, and even where conduit is not required, adapters according to embodiments of the invention may use most, if not all, of the structures within the adapter 10.

Figure 4:
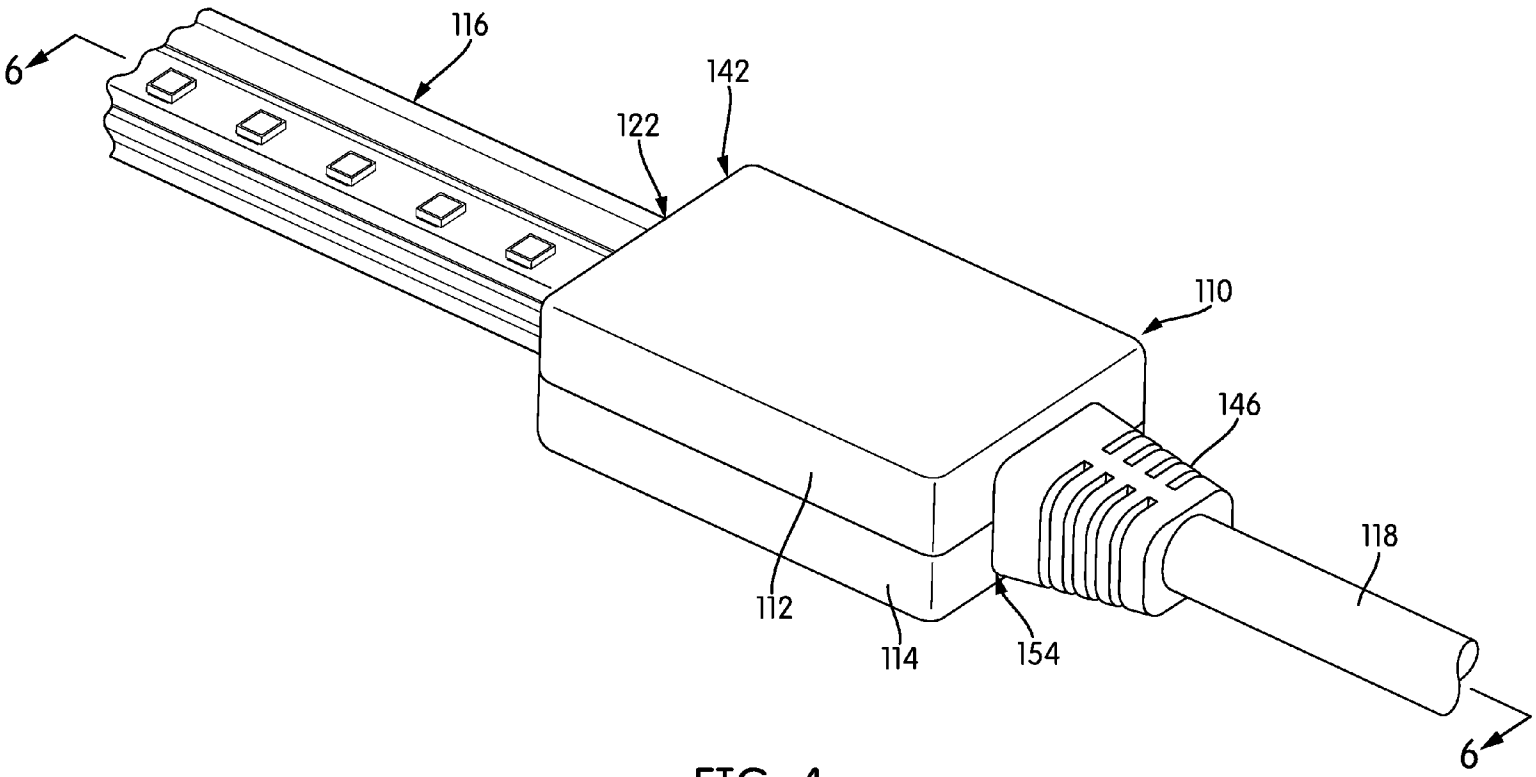
FIG. 4 is a perspective view of an adapter according to another embodiment of the invention, shown as installed.

As one example, FIG. 4 is a perspective view of an adapter 110. Unless otherwise noted, the features of adapter 110 may be assumed to be substantially similar to the features of the adapter 10, such that the description applies to the features of the adapter 110. Essentially, the adapter 110 has the same features of the adapter 10 without the adapter opening 20 that connects to conduit. The adapter 110 has a housing comprised of interengaged upper and lower portions 112, 114.

In this embodiment of the invention, a strip light 116 enters the adapter 110 through a high-voltage strip light opening 122 located on a receiving end 142 of the adapter 110. Like the adapter 10 described above, the adapter 110 houses an electrical connection 144 (best visible in the view of FIG. 5) that connects the high-voltage strip light 116 to a standard power cord 118. The power cord 118 is routed out of the adapter 110 through a power cord opening 154, with a strain relief portion 146 attached on an outer surface around the power cord opening 154 to provide strain relief for the power cord 118. Depending on the application and the particular installation, the power cord 118 may terminate in a standard plug for connecting to a typical electrical outlet, or it may be designed to be connected to power within an electrical junction box.

As was noted above, the adapter 110 does not require lengths of electrical conduit 30 and a junction box 32, thus allowing for rapid installation and removal, and allowing the strip lighting 116 to be placed and rearranged as necessary without too much difficulty. Yet because its internal features are very similar to those of the adapter 10, it provides an internal barrier 126 to prevent electrical short circuits and many of the other fixation and safety features provided by the adapter 10. For additional safety, a standard power cord 118 may be fortified with additional electrical insulation (e.g., double jacketed) if necessary. Generally speaking, the adapter 110 is particularly suitable for making connections in interior spaces, or in exterior lighting applications where the location is dry or otherwise protected from the elements.

Figure 5:
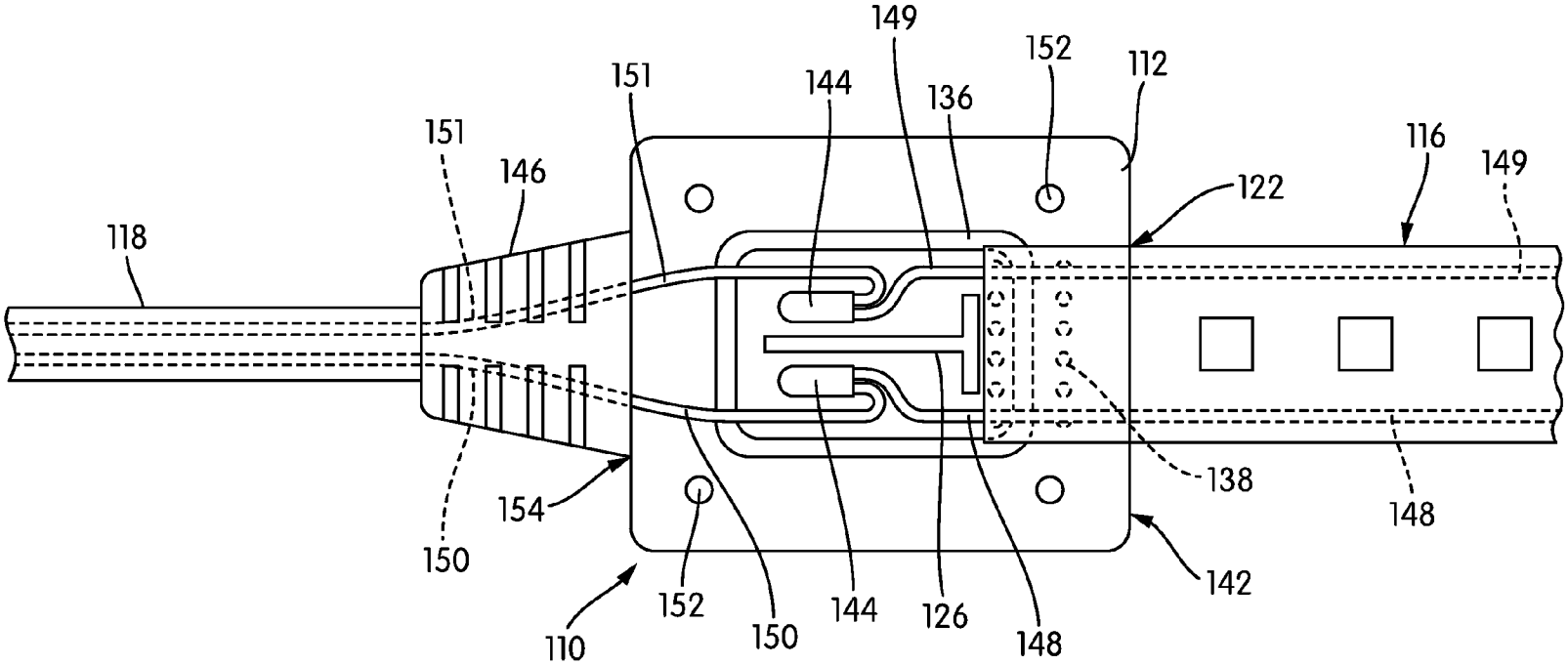
FIG. 5 is schematic top plan view of the adapter of FIG. 4, illustrating its interior.

FIG. 5 is a schematic top plan view, illustrating the interior of the adapter 110. As can be appreciated from FIG. 5, the receiving end of the adapter 142 receives a high voltage strip light 116 through a high voltage strip light opening 122. A crimped electrical connection 144 is housed within the adapter 110, joining a length of high-voltage strip light 116 to a standard electrical power cord 118. More specifically, a crimp connection 144 joins a positive strip light electrical lead 148 to a positive cord electrical lead 150, while a separate crimp connection 144 joins a negative strip light electrical lead 149 to a negative cord electrical lead 151.

As was described briefly above, the interior of the adapter 110 provides a number of useful features to assist in making a proper and robust electrical connection, and many of those features are similar to the features described above with respect to the adapter 10. When the upper and lower portions 112, 114 of the adapter 110 are interengaged by fasteners 34 inserted through fastener openings 152, a watertight seal is formed by at least one silicone gasket 136, which encircles and encloses at least the area where the leads 148, 149, 150, 151 are exposed. Additionally, as was described briefly above, a T-shaped vertical wire barrier 126 prevents short circuits within the adapter 110, by preventing the electrical leads 148 from touching. Finally, a plurality of prongs 138 both fix the high-voltage strip light in place and provide strain relief, as is described above.

Figure 6:
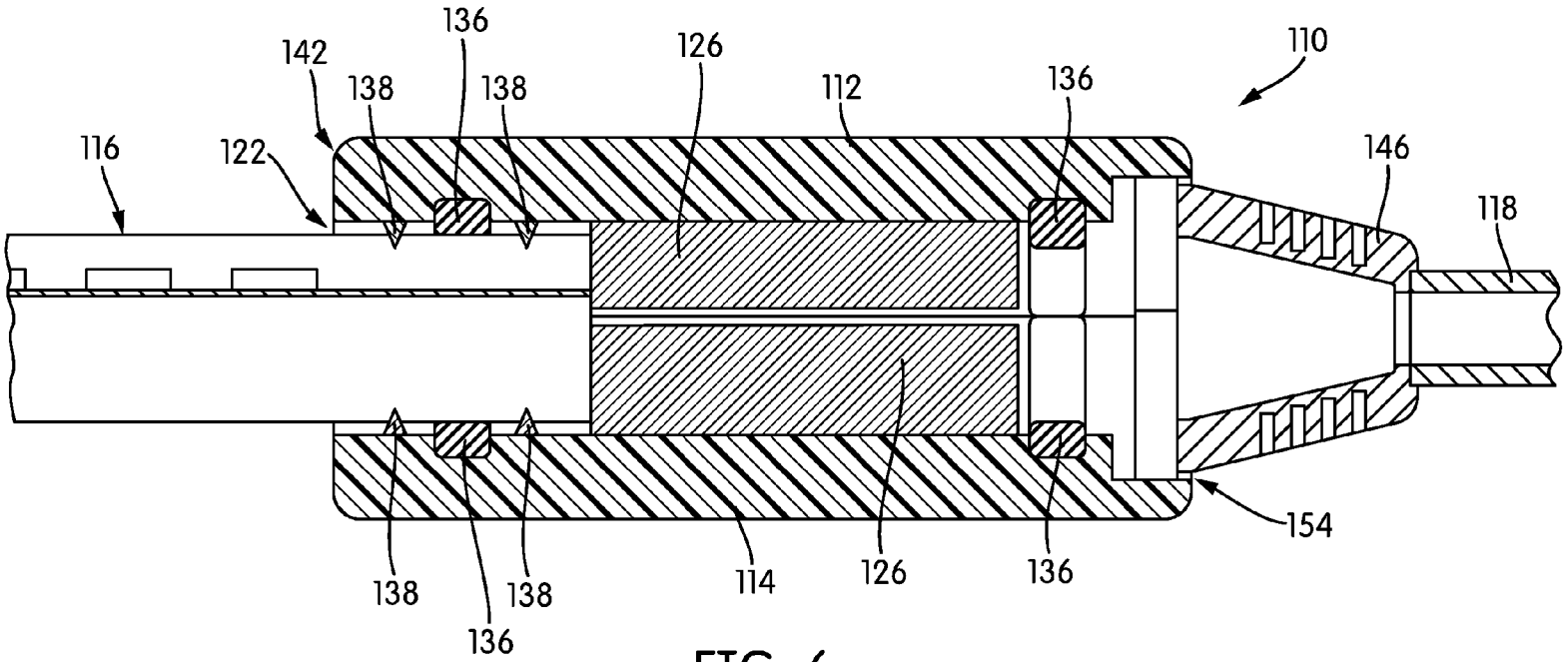
FIG. 6 is a cross-sectional side view of the adapter, taken through Line 6-6 of FIG. 4.

FIG. 6 is a cross-sectional side view of the adapter 110, shown with the strip light 116 installed, to better illustrate certain interior features of the adapter 110. Those features include the wire barrier 126, the gasket 136, and the series of prongs 138. The purpose and function of each of these internal features is similar to that in the embodiment of the adapter 10, as described above.

A portion of the wire barrier 126 extends from each of the upper and lower portions 112, 114 respectively, such that when the two portions 112, 114 of the adapter 110 are interengaged, the wire barrier 126 isolates power leads 148, 150 from ground leads 149, 151. (Which leads convey power and which leads are ground is immaterial with respect to the illustrated embodiment of the adapter 110; this will depend on the configuration of the strip light 16, 116.) The portions of the wire barrier 126 may have relative heights chosen such that there is a small vertical gap between them, shown in FIG. 6, which would allow the power and ground leads 148, 149 to be sandwiched between the upper and lower portions of the transverse portion of the barrier 126 to hold them in place. If a gap is not provided, holes or other openings in the wire barrier 126 may be provided to allow the power and ground leads 148, 149 to reach the strip light 116. As was described above with respect to the wire barrier 26, the wire barrier 126 may prevent electrical short circuits by providing physical separation between power and ground leads, as can best be seen in FIG. 5.

The gaskets 136 are generally described above and are similarly employed in both embodiments of the adapter 10, 110. In the view of FIG. 6, it can be seen that two opposing gaskets 136, one in the upper portion 112 and one in the lower portion 114, provide a seal around the area of the wire barrier 126, such that when the two portions 112, 114 are engaged, the two gaskets 136 abut each other to form a seal. As was described briefly above, and as can be seen toward the power cord side of FIG. 6, the gaskets 136 dip up and down, becoming mirror images of one another, to seal the two openings 122, 154.

The multiple series of prongs 138 of the adapter 110 are comparable to the series of prongs 38 from the adapter 10, and are placed in a similar physical relationship with one another. In gripping the strip light 116, they may or may not penetrate the insulation of the strip light 116, and if they do penetrate the insulation of the strip light 116, that penetration will generally be slight, rather than a full-thickness penetration. In other words, the prongs 38, 138 are intended to grip the strip light 16, 116, and they may make an impression or a slight penetration of the insulation of the strip light 16, 116 in doing so, but should not compromise the insulation.

As those of skill in the art will note, neither embodiment of the adapter 10, 110 includes a transformer, a rectifier, or other such elements; rather, the connection is made directly from power and ground leads of the power cord to power and ground leads of the strip light 16, 116. This assumes that the strip light 16, 116 carries a rectifier or rectifiers, as disclosed in U.S. Provisional Patent Application No. 62/344,670, filed Jun. 2, 2016, the contents of which are incorporated by reference in their entirety. However, if AC-to-DC power conversion or voltage conversion is needed, those elements could also be included within the adapter 10, 110, e.g., by elongating the adapter and placing those components toward the power cord end.

While the invention has been described with respect to certain embodiments, the description is intended to be exemplary, rather than limiting. Modifications and changes may be made within the scope of the invention, which is defined by the appended claims.

What is claimed is:

1. A power adapter for a strip light, comprising:

a housing with a first opening adapted to accept an end of a strip light, a second opening adapted to accept a power cord, and an interior cavity into which the first and second openings open;

a vertical barrier within the interior cavity and with upper and lower portions attached to one or both of interior upper and lower surfaces of the housing, the vertical barrier having a longitudinal portion aligned with a long axis of the power adapter and a transverse portion essentially perpendicular to the longitudinal portion and parallel to the first opening; and a pair of gaskets sealing an area around the vertical barrier, the gaskets also sealing at least a portion of the perimeter of the first opening; and gripping structures extending from respective inner upper and lower faces of the housing;

wherein the housing houses an electrical connection between first power and ground leads from the power cord and second power and ground leads from the strip light such that the respective power and ground leads are separated on opposite sides of the vertical barrier.

2. The power adapter of claim 1, wherein the gripping structures are arranged in rows.

3. The power adapter of claim 2, wherein there are multiple rows of gripping structures spaced from one another.

4. The power adapter of claim 3, wherein a first row of gripping structures is placed within the area sealed by the pair of gaskets and a second row of gripping structures is placed outside the area sealed by the pair of gaskets toward the first opening.

5. The power adapter of claim 1, wherein the first opening is rectangular.

6. The adapter of claim 1, further comprising a flexible strain relief portion attached to the adapter and carrying the power cord externally, proximate to the second opening.

7. The adapter of claim 1, wherein the upper portion of the vertical barrier is attached to the interior upper surface of the housing and the lower portion of the vertical barrier is attached to the interior lower surface of the housing.

8. The adapter of claim 7, wherein heights of the upper and lower portions are chosen such that there is a vertical gap between the upper portion and the lower portion.

9. The adapter of claim 1, wherein the first opening is rectangular.

* * * * *